US006553693B1

(12) United States Patent
Desmarais et al.

(10) Patent No.: US 6,553,693 B1
(45) Date of Patent: Apr. 29, 2003

(54) SNOW REMOVAL APPARATUS AND METHOD OF USING SAME

(75) Inventors: Lionel Charles Desmarais, Bolton (CA); Andrew Smith Jackson, Cambridge (CA); Bernie A. Stene, Landsdowne (CA); Mark E. Nye, Mississauga (CA)

(73) Assignee: 360fiber ltd., Mississauga (CA)

( * ) Notice: Subject to any disclaimer, the term of this patent is extended or adjusted under 35 U.S.C. 154(b) by 0 days.

(21) Appl. No.: 09/579,451

(22) Filed: May 26, 2000

(51) Int. Cl.[7] ..... E01H 5/10; B61F 19/00
(52) U.S. Cl. ..... 37/227; 104/279
(58) Field of Search ..... 37/227, 228; 104/279; 105/722, 215.2, 238.1, 355; 280/160

(56) References Cited

U.S. PATENT DOCUMENTS 3,041,748 A * 7/1962 Wetzel ..... 37/227
3,228,125 A * 1/1966 Wiebe ..... 37/227
4,286,943 A * 9/1981 Petlak et al. ..... 431/352
5,642,673 A * 7/1997 Lucky, Sr. ..... 104/279

* cited by examiner

*Primary Examiner*—Robert E. Pezzuto
(74) *Attorney, Agent, or Firm*—John Russell Uren

(57) ABSTRACT

A snowblower apparatus and a method of using the snowblower. The snowblower apparatus is self contained and portable and may be mounted on a prime mover. A turbine engine is located within a housing and discharges its exhaust to the desired area of snow or ice removal. The housing is rotatable and tiltable about orthogonal axes so as to allow the operator to direct the discharge nozzle to a desired location. A fuel tank may be mounted separately from the housing and turbine engine. An afterburner may be used to increase the exhaust temperature thereby to remove ice and otherwise dry the desired location.

12 Claims, 8 Drawing Sheets

SNOW REMOVAL APPARATUS AND METHOD OF USING SAME

This invention relates to a method and apparatus for removing snow and, more particularly, to a method and apparatus for removing snow using a self-contained turbine engine with flexible operating characteristics which has particular application in association with railways.

BACKGROUND OF THE INVENTION

Snow removal equipment for roads and railway tracks is, of course, well known. In relation to railway tracks, the type of snow removal has generally been a plow and/or blower mounted on the forward end of an engine or an independently powered snowplow and/or blower. Turbine engines for powering snow removal equipment and using the exhaust from such engines are also known. Typically, the snow removal equipment used for clearing railway track cuts a passage of standard train width to allow subsequent passage of the train. The snow is suctioned into a large fan rotating at high speed and is then blown by the fan some distance from the track. The fan is powered by high horsepower engines. Where the exhaust of a turbine engine is used, the turbine engine generally is very large and has a dedicated prime mover to provide operating controls and equipment support.

Although the apparatuses presently used for clearing railway track work relatively well for the applications in which they are used, there are disadvantages inherent in the apparatuses if intended to be used for other applications. First, the forces created to suction in the snow and blow it a distance from the track are large. Ballast under the track is ingested as well as the snow with the result that the ballast bed beneath the track may be damaged. If there is considerable snow present over the winter, the ballast may have to be replaced which is time consuming and expensive. Second, there is little flexibility in the use of the present apparatuses. The cleared pass is of a certain width, primarily the width required for a passing train and this width is not adjustable. If it desired to clear adjacent track switches and the track extending from the switches, a further pass along the switch and track must be made. Third, if a relatively small area located away from the track is desired to be cleared of snow such as at a distance marker or other instructional sign, it must be cleared manually since the snowplow and/or blower is not adapted for such snow clearing.

SUMMARY OF THE INVENTION

According to one aspect of the invention, there is provided apparatus for removing snow comprising a turbine engine having intake and exhaust sections and being operably connected to a base, a discharge nozzle operably connected to said exhaust section and adapted to discharge said exhaust to an area of interest and controls to initiate operation of said turbine engine and to increase and decrease the power of said exhaust discharging from said discharge nozzle, said turbine engine being rotatable and tiltable relative to said base and said turbine engine having an afterburner to increase the temperature of said exhaust discharging from said discharge nozzle.

According to a further aspect of the invention, there is provided a method for removing snow from a desired location comprising initiating operation of a turbine engine mounted on a base, ingesting air from ambient surroundings into said turbine engine, discharging said exhaust from said turbine engine into a discharge nozzle, rotating and/or tilting said turbine engine and discharge nozzle relative to said base and raising the temperature of said exhaust prior to discharge of said exhaust from said discharge nozzle.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
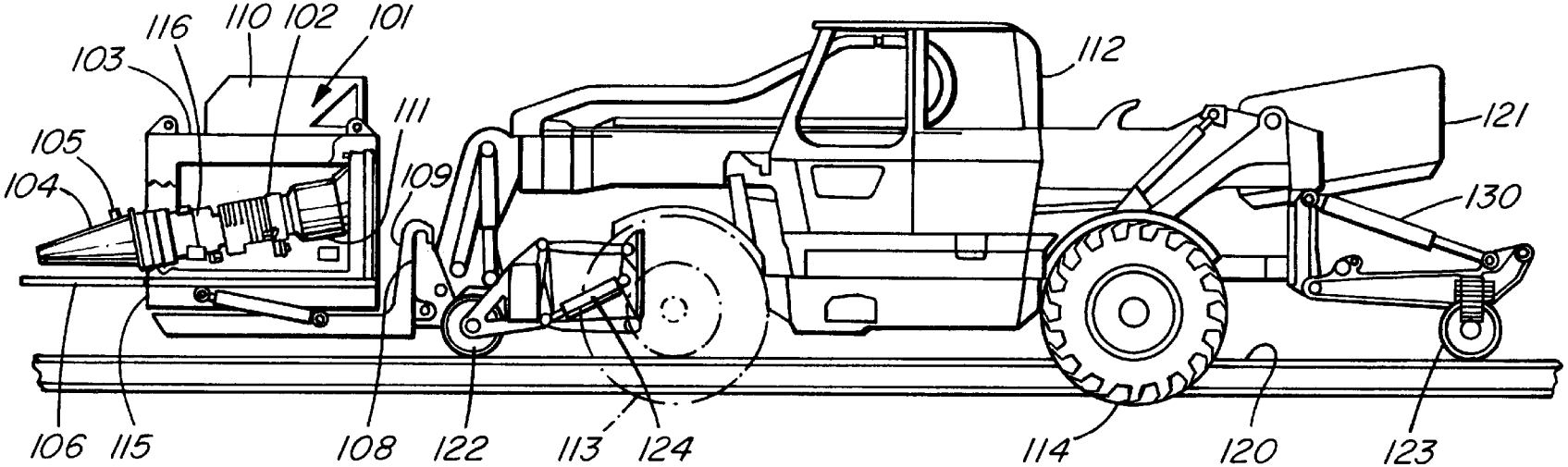
FIG. 1 is a diagrammatic side view of the snow removal apparatus according to one aspect of the invention, the apparatus being mounted on a prime mover.

Referring now to the drawings, a snow removal apparatus according to the invention is illustrated generally at 100 in FIG. 1. The snow removal apparatus 100 includes a snow blower generally illustrated at 101. Snow blower 101 includes a housing 103 within which a turbine engine 102, conveniently a modified General Electric T58 turbine engine, is located. The T58 engine produces approximately 1400 HP and has approximately an 11000 CFM rating. A discharge nozzle 104 extends from the forward end of the housing 103 and a nozzle temperature sensor 105 extends from the discharge nozzle 104 to provide temperature information within the discharge nozzle 104.

A steel guard 106 is connected to the housing 103 and provides protection to the discharge nozzle 104 from inadvertent contact with objects and the like during operation.

An air inlet 110 on top of the housing 103 allows air to enter the housing 103 and, therefore, the air intake end 111 of the turbine engine 102 as will be described.

The housing 103 is mounted on the forward end of a prime mover 112, conveniently a tractor of the non-articulated variety but having "crab" steering, namely steerable forward and rearward pneumatic tires 113, 114, respectively, which allow the prime mover 112 to be quickly removed from the railway tracks 120 on which it is operating. This is convenient if a train is expected.

A fuel tank 121 is mounted on the rearward end of the prime mover 112. The fuel from the fuel tank 121 is used for the turbine engine 102 of the snow removal apparatus 100. A fuel line runs between the turbine engine 102 and the fuel tank 121.

Rail wheels 122, 123 are mounted on the forward and rearward ends of the prime mover 112, respectively. The rail wheels 122, 123 are hydraulically raised and lowered with hydraulic cylinders 124, 130, respectively. In the event the snow removal apparatus 100 is intended to be driven off the track 120, the hydraulic cylinders 124, 130 are activated to raise the railwheels 122, 123 off the track whereupon all the weight of the prime mover 112 and the snow removal apparatus 100 will rest on the pneumatic tires 113, 114 and the prime mover 112 can be independently and easily driven off the rails 120.

Figure 3A:
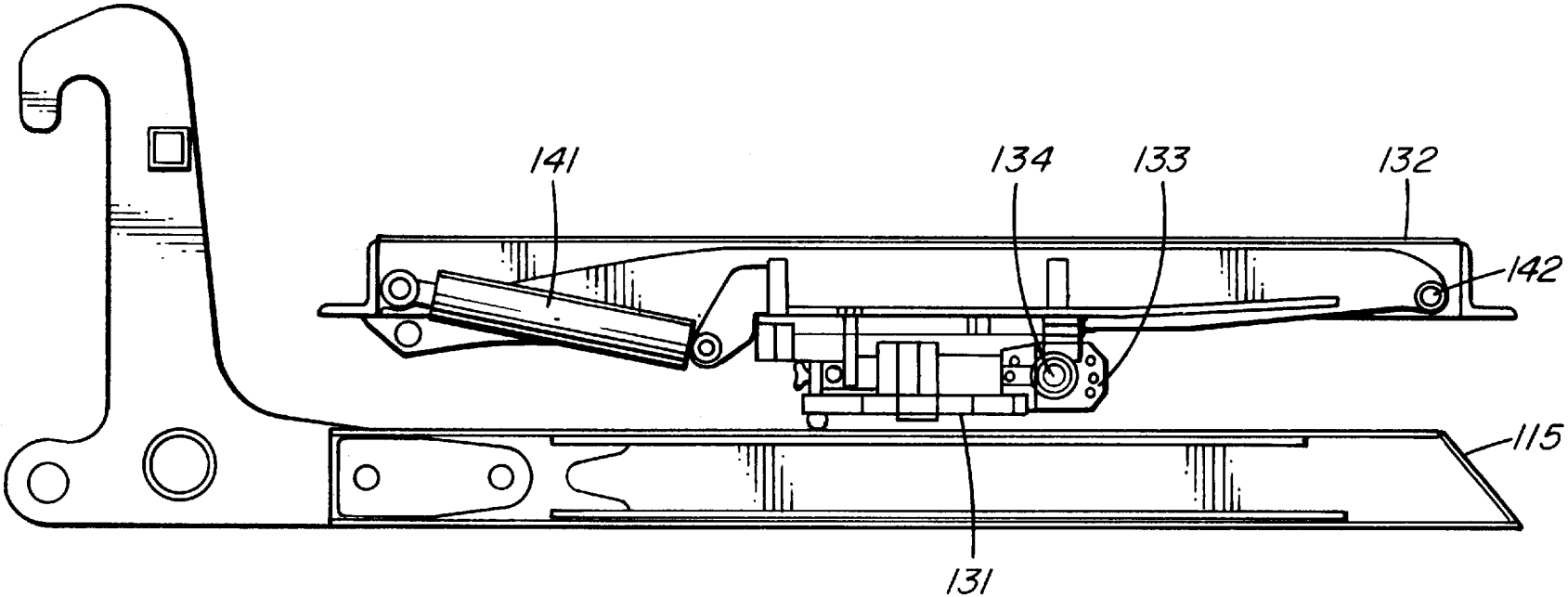
FIG. 3A is a diagrammatic side view of the tilt and turn table used with the snow blower according to the invention.
Figure 3B:
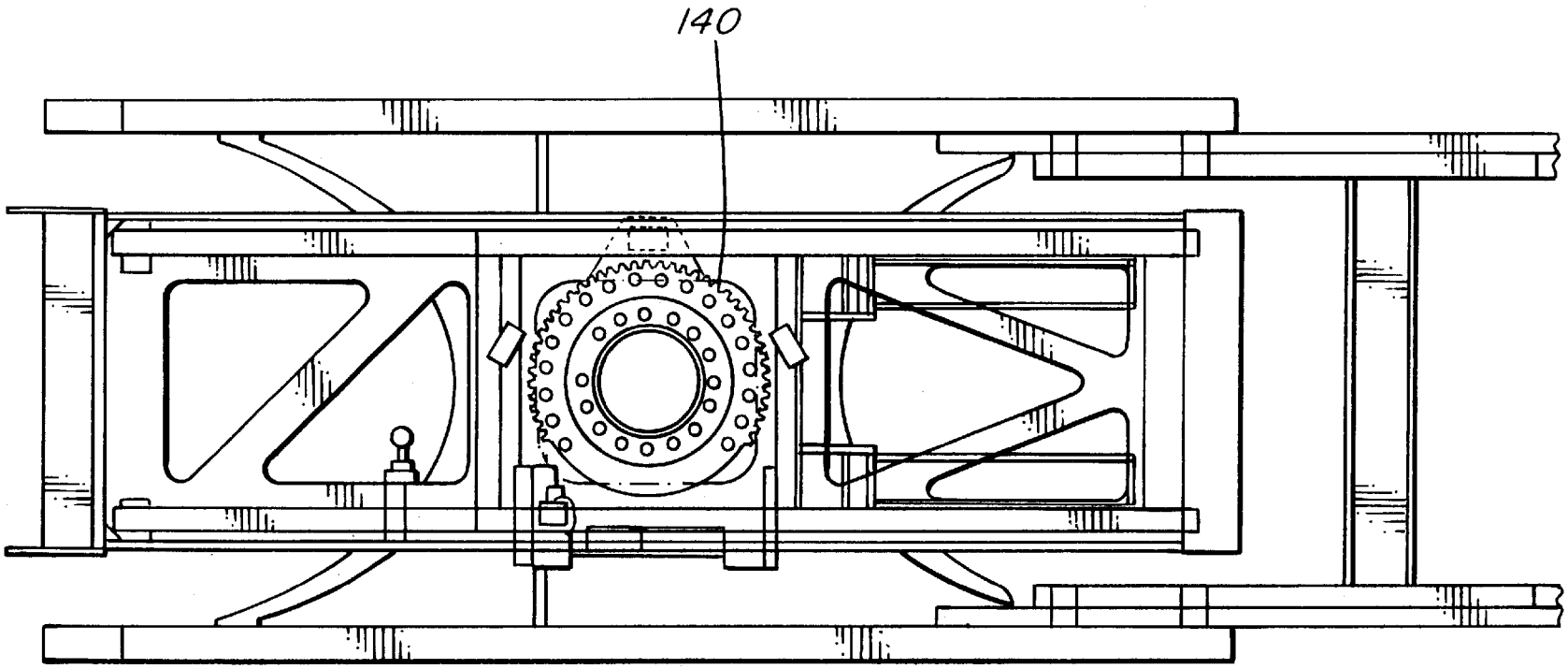
FIG. 3B is a diagrammatic plan view of the tilt and turn table of FIG. 3A.

The housing 103 is mounted on a table 132 which Is, in turn, mounted on a turntable 131 best seen in FIG. 3A. The turntable 131 is mounted on a base 115. A hydraulic motor 133 runs a gear 134 which meshes with a complementary matching circumferential gear 140 connected to the turntable 131 and thereby rotates the table 132. A tilt mechanism includes a hydraulic cylinder 141 which extends between the table 132 and the turntable 131. As the hydraulic cylinder 141 is extended and retracted, the table 132 rotates upwardly and downwardly about axis 142 thereby tilting the housing 103 and the attached discharge nozzle 104.

Figure 5A:
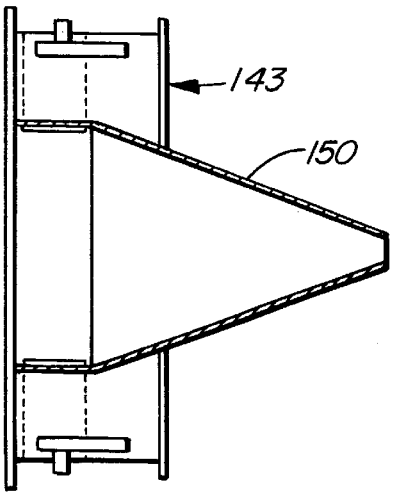
FIGS. 5A and 5B are side and axial views, respectively, of a stator plate used with the turbine engine is of FIG. 1.
Figure 5B:
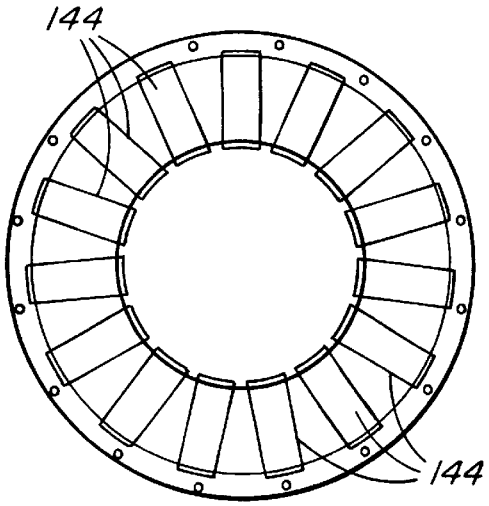

The turbine engine 102 used for the snowblower 100 was originally used for helicopter purposes and had a third nozzle stage that gave a substantial tangential component to the combustion gases downstream from the combustion chamber. To alter the flow of gases and reduce the sidewise velocity components, a stator plate generally illustrated at 143 (FIGS. 5A and 5B) is added downstream of the third stage nozzle of the turbine engine 102. The blades or vanes 144 have a more open configuration and allow the gases to more readily pass from the third stage nozzle to the discharge nozzle 104 since the flow passage is less constricted by the blades 144. In addition to the configuration of the blades 144, a cone 150 is likewise added in an attempt to reduce backpressure and any turbulence within the discharge nozzle 132 caused by the abrupt ending of the third stage nozzle when the turbine engine 102 was adapted for the snow blowing application.

Figure 4A:
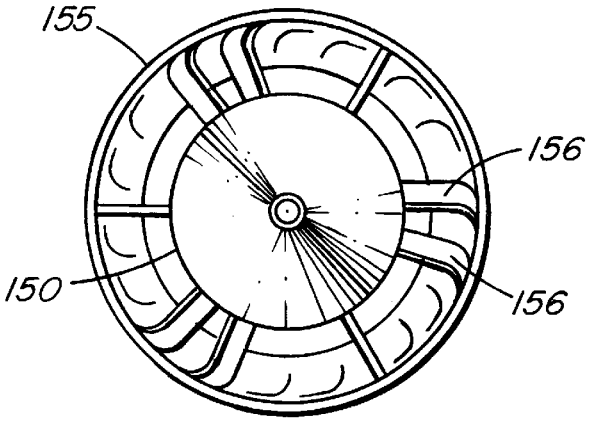
FIG. 4A is a front axial view of the nozzle used in the turbine engine of FIG. 1.
Figure 4B:
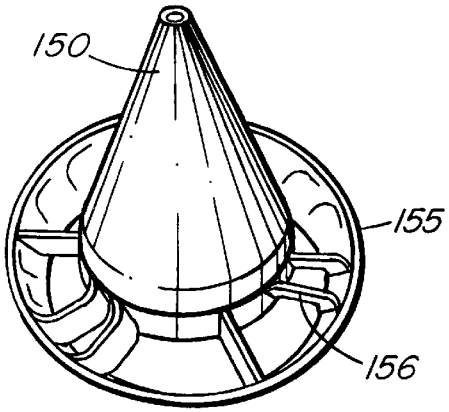
FIG. 4B is an isometric view of the nozzle of FIG. 4A.

Subsequently, a newly designed third stage nozzle member 155 was designed as seen in FIGS. 4A and 4B. This nozzle member 155 also included the cone member 150 of the insert of FIGS. 5A and 5B. The technique used was to simply remove many vanes or blade 156 from the original nozzle member 155 and add the cone 150 by welding it to the nozzle member 155. The advantage of this configuration is that no stator member is required.

Figure 6A:
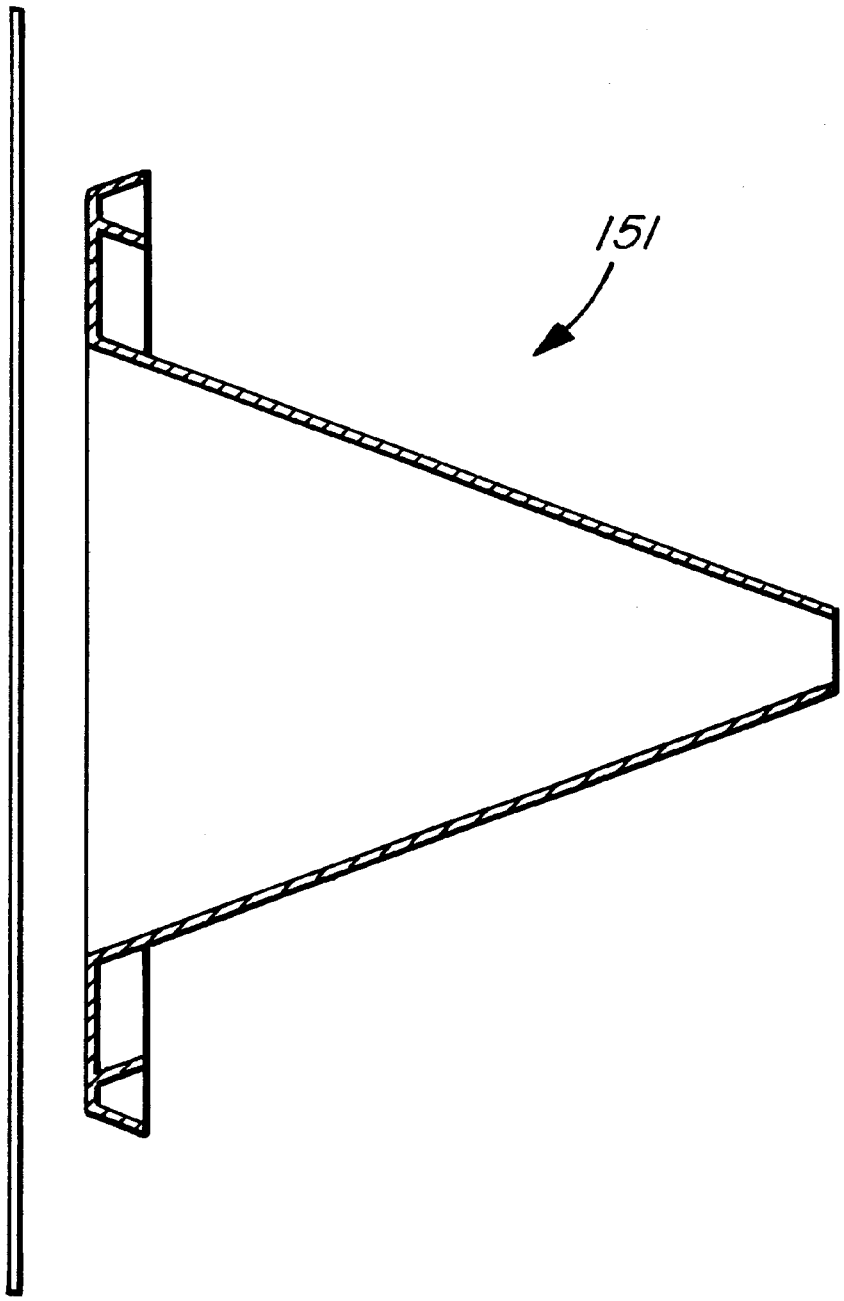
FIGS. 6A and 6B are side and axial views of the afterburner flame holder used with the turbine engine of FIG. 1.
Figure 6B:
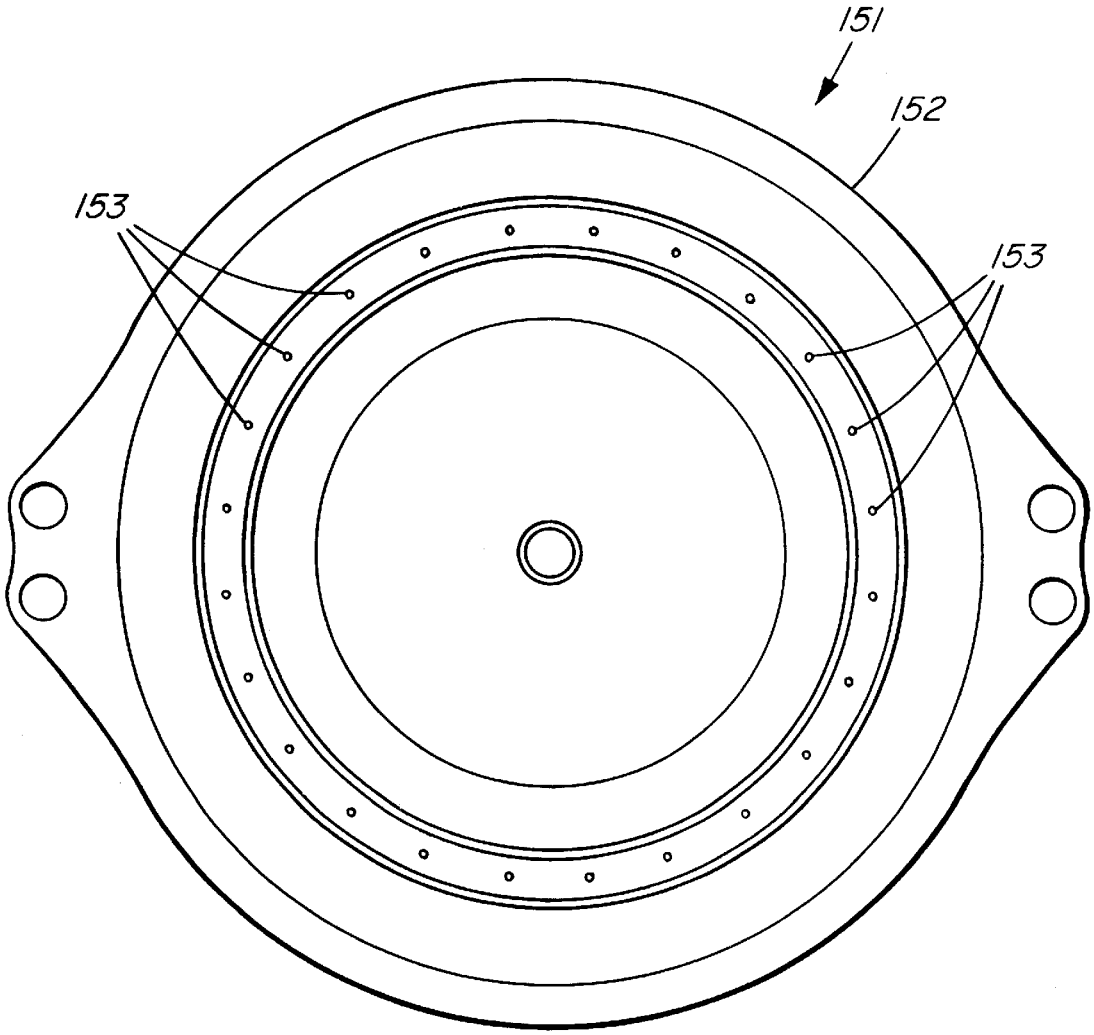

The afterburner is generally illustrated at 151 (FIGS. 6A and 6B) and is used to increase the temperature of the air being discharged from the turbine engine 102 and the discharge nozzle 104 if required. This temperature increase can be important since, if ice is present, it may not be removed with the blown snow. By increasing the temperature of the discharged air, the ice can be melted and any specific areas desired may be dried to avoid the reformation of ice. This is useful for switches and the like which may not function if encased in ice following a storm or where melting and subsequent freezing conditions are encountered.

The afterburner 151 includes a plate 152 similar to the stator plate described in relation to FIGS. 4A and 4B. However, no blades are present and the plate 152 is mounted downstream of the third stage nozzle 155. A series of atomising fuel injectors 153 are positioned about the circumference of the plate 152. Fuel and air are supplied to the injectors 153 which atomise the fuel. A raw fuel injector 116 (FIG. 1) is mounted in the turbine engine 102 upstream of the injectors 153. The raw fuel injector 116 injects raw fuel into the operating engine which then ignites in a "streak" of flame. The streak is displaced downstream where it comes into contact with the atomised fuel ejected from injectors 153. The atomised fuel from injectors 115 ignites thereby increasing the temperature of the discharged gases from the turbine engine 102 and the discharge nozzle 104.

Figure 7A:
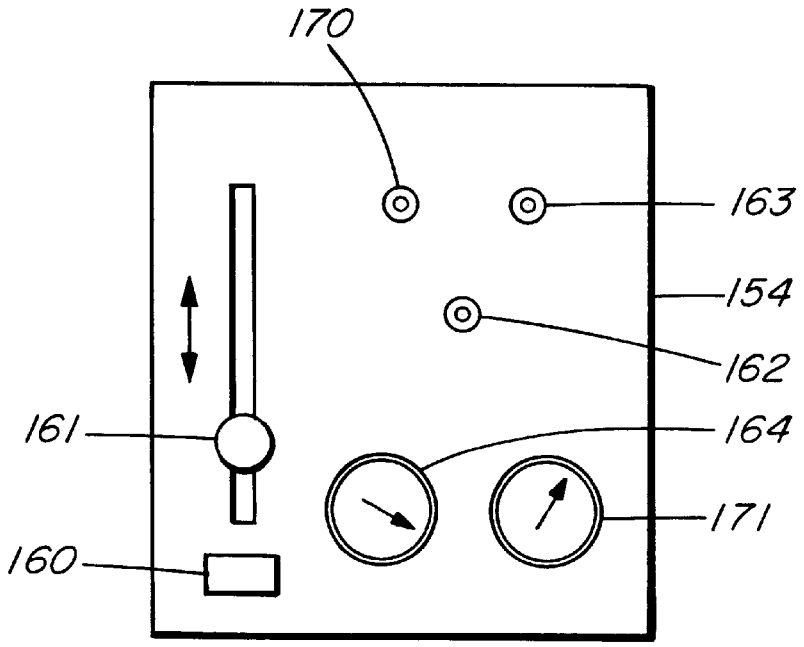
FIGS. 7A and 7B illustrate the typical operating controls of the turbine engine and afterburner according to the invention.
Figure 7B:
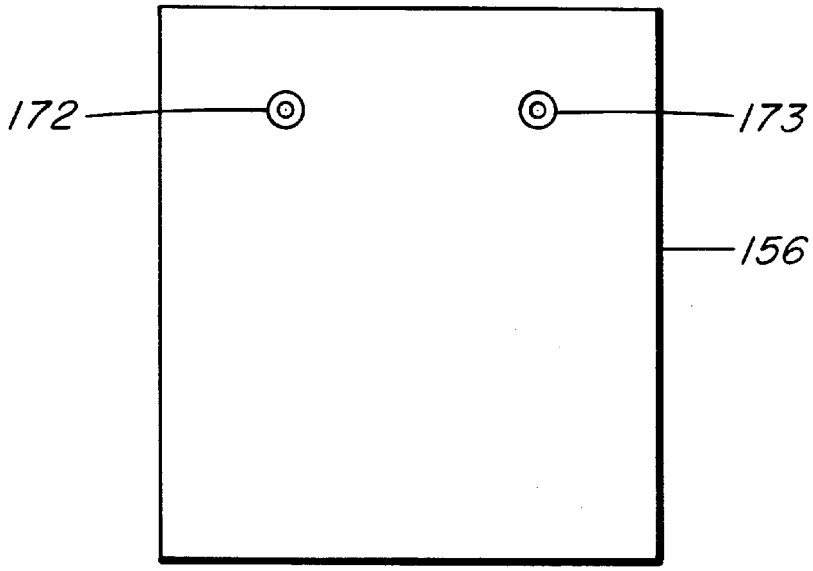

Control panels 154, 156 (FIGS. 7A and 7B) are provided for the operator. The control panel 154 includes a series of switches and gages which allow the operator to initiate ignition of the turbine engine 102 and to monitor its operation. A master switch 160 allows electrical power to be applied to the turbine engine 102. A throttle switch 161 allows the fuel in the turbine engine to be increased or decreased. An igniter switch 162 creates an initial spark to initiate combustion of the fuel. A spring loaded starter switch 163 will rotate the engine until a predetermined percentage of rpm, conveniently 19%, is reached, as shown on gage 164. An exhaust temperature gage 171 allows the temperature of the exhaust discharging from the discharge nozzle 104 to be monitored and a switch may be provided for the addition of extra fuel.

Additional controls are provided for the afterburner 151 as viewed in FIG. 7. A fuel discharge switch 172 allows pulsed raw fuel to be released upstream of the injectors 153. An injector switch 173 allows atomised fuel to flow from the injectors 153 to be ignited by the fuel released by operation of the fuel discharge switch 172.

OPERATION

In operation, it will be appreciated that the snow blower 101 and fuel tank 121 are self contained units and that they may be mounted on any convenient prime mover including the rail mounted prime mover 112 of FIG. 1. As seen in FIG. 1, the snowblower 101 has a blower attachment member 109 which is complementary to attachment member 108 on prime mover 11 so the snow blower 101 is conveniently connected and removed as desired.

The prime mover 112 will be transported or otherwise moved to the desired operating position which location, for example, may be adjacent a switch extending off a main track line that has been previously cleared by other means.

Figure 2:
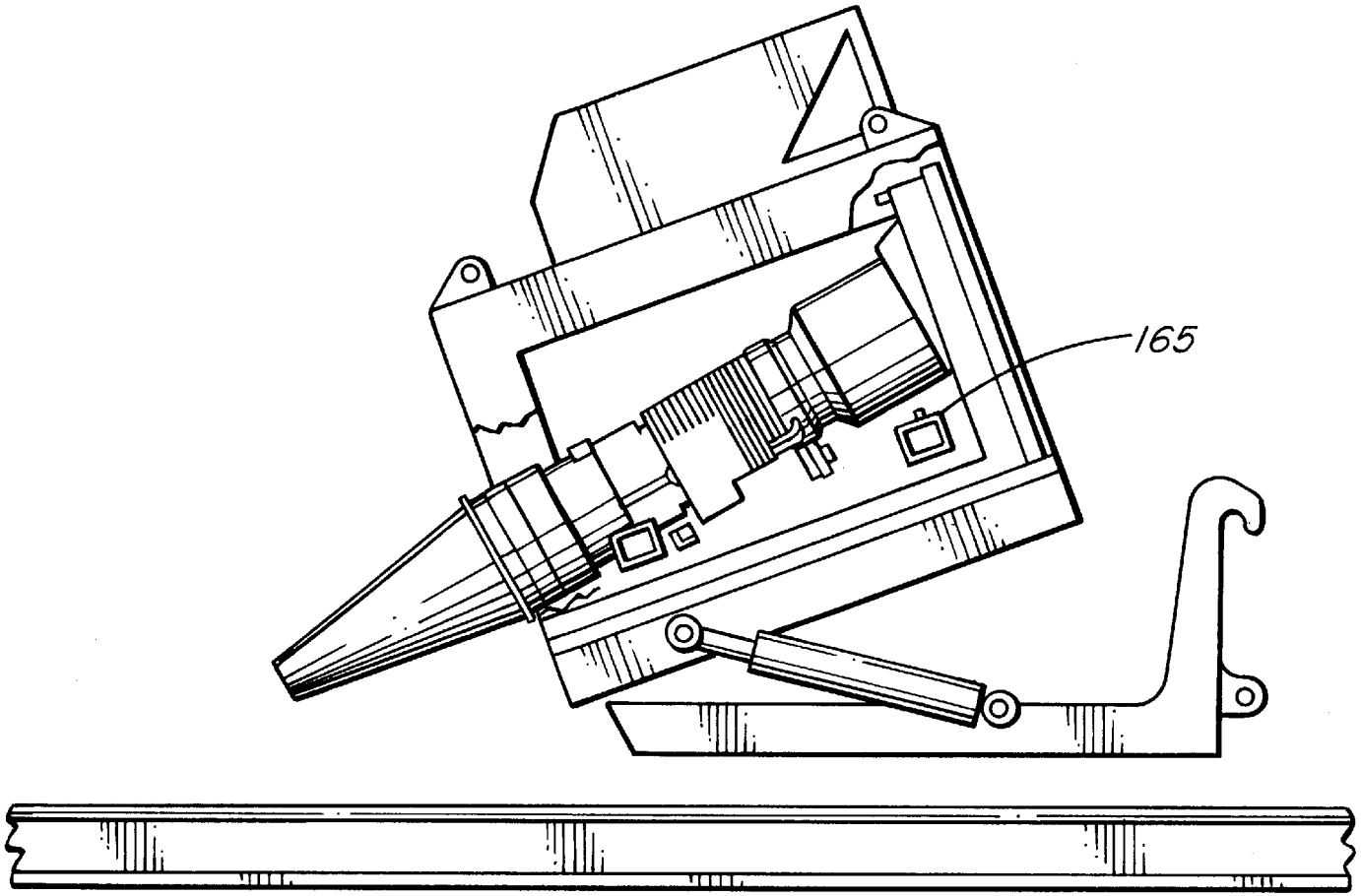
FIG. 2 is a diagrammatic side view of the snow blower of FIG. 1 and illustrating the snow blower in its tilted position.

Operation of the turbine engine 102 will be initiated. Master switch 160 will be turned on to allow power to flow from a battery 165 (FIG. 2) within housing 103. The throttle 161 will be set at its minimum position. The igniter switch 162 is activated to create a spark to initially ignite the fuel. The starter switch 163 rotates the engine until, conveniently with the GE T58 turbine 102, the percentage rpm reaches approximately 19% as shown on gage 164. The throttle 161 is then moved to its idle position somewhat above its minimum position. The start fuel switch 170 is turned on to allow fuel to flow until the rpm gage 164 reaches approximately 55–60%. The starter switch 163, being a spring loaded toggle, is released and the turbine 102 is then under operation. It is important to view the gauges 164, 171 during operation to ensure that the exhaust temperature as shown on gage 171 remains within a predetermined range and that the rpm of the turbine engine 102 is similarly within a desired operating range.

The housing 103 and, accordingly, the turbine engine 102 and discharge nozzle 104 may be tilted and/or rotated by the operator relative to the base 115 by operating hydraulic motor 133 which will rotate gear 134 and thereby rotate the turntable 131 on which the housing 103 is mounted. Likewise, hydraulic cylinder 141 may be extended or retracted to raise or lower one side of the table 132 which rotates about axis 142 when being raised or lowered. The operator may easily direct the exhaust discharging from the discharge nozzle 104 at any desired location without necessarily requiring any movement of the prime mover 112 during operation of the snow blower 102.

In certain applications, particularly where ice may be present and/or it is desired to dry a track or other location, the afterburner 151 is useful to heat the temperature of the exhaust being discharged by the discharge nozzle 104. To initiate operation of the afterburner 151, the fuel discharge switch 172 (FIG. 6B) is initiated. This fuel discharge switch 172 allows a pulsed raw fuel discharge from fuel injector 116 (FIG. 1). The pulsed raw fuel is ignited by the temperature of the exhaust upstream of the injectors 153 and creates a "streak" of flame directed rearwardly. The injector switch 173 is operated to allow atomised fuel to be released by the injector nozzles 153 and this fuel is ignited by the streak of raw fuel passing to the injectors 153. Thus, a ring of combustion flame will be formed within the injectors and downstream therefrom which will heat the exhaust and provide increased heat to the area receiving the nozzle discharge.

Many modifications will readily occur to those skilled in the art to which the invention relates and the specific embodiments herein described should be taken as illustrative of the invention only and not as limiting the invention as defined in accordance with the accompanying claims.

We claim:

1. Apparatus for removing snow comprising a turbine engine having intake and exhaust sections and being operably connected to a base, a discharge nozzle operably connected to said exhaust section and adapted to discharge said exhaust to an area of interest and controls to initiate operation of said turbine engine and to increase and decrease the power of said exhaust discharging from said discharge nozzle, said turbine engine being rotatable and tiltable relative to said base, an operator's station being separate from said base and operable to control said turbine engine, said operator's station remaining stationary during said rotatable and tiltable movement of said turbine engine relative to said base, said turbine engine having an afterburner to increase the temperature of said exhaust discharging from said discharge nozzle.

2. Apparatus as in claim 1 wherein said turbine engine is mounted within a housing and said housing is operably connected to said base.

3. Apparatus as in claim 2 wherein said housing is operably connected to said base through a turntable type connection member to allow said housing to rotate about a vertical axis relative to said base.

4. Apparatus as in claim 2 wherein said housing is operably connected to said base through an axis allowing said housing to tilt about a horizontal axis relative to said base.

5. Apparatus as in claim 2 and further comprising a fuel tank for said turbine engine.

6. Apparatus as in claim 5 and further comprising a prime mover, said housing and said fuel tank being removably connected to said prime mover.

7. Apparatus as in claim 6 wherein said housing is removably mounted on one end of said prime mover and said fuel tank is removably mounted on the other end of said prime mover.

8. Method for removing snow from a desired location by an operator positioned at an operator's station, said method comprising initiating operation of a turbine engine mounted on a base by providing fuel to said turbine engine, ingesting air from ambient surroundings into said turbine engine, discharging exhaust from said turbine engine into a discharge nozzle, rotating and tilting said discharge nozzle relative to said operator's station during operation and raising the temperature of said exhaust prior to discharge of said exhaust from said discharge nozzle, said discharge nozzle and said turbine engine being rotatable and tiltable while said operators's station is maintained in said stationary position relative to said discharge nozzle and said turbine engine.

9. Method as in claim 8 and further comprising ingesting air through an air intake in a housing within which said turbine engine is mounted.

10. Method as in claim 9 and further comprising mounting said housing on a prime mover and moving said prime mover to a desired location with said housing.

11. Method as in claim 10 and further comprising providing fuel to said turbine engine from a fuel tank located remotely from said turbine engine.

12. Method as in claim 11 and further comprising mounting said ho using on one end of said prime is mover and mounting said fuel tank on the opposite end of said prime mover.

* * * * *